US005302203A

United States Patent [19]

Zimmer

[11] Patent Number: 5,302,203

[45] Date of Patent: Apr. 12, 1994

[54] APPARATUS FOR PRESSING WEBS USUALLY IN CONTACT WITH A FLOWABLE SUBSTANCE

[76] Inventor: Johannes Zimmer, Ebentaler Strasse 133, A-9020 Klagenfurt, Austria

[21] Appl. No.: 727,622

[22] Filed: Jul. 10, 1991

[30] Foreign Application Priority Data

Jul. 10, 1990 [AT] Austria ..... 1468/90
Aug. 6, 1990 [AT] Austria ..... 1649/90

[51] Int. Cl.[5] ..... B05C 1/08

[52] U.S. Cl. ..... 118/117; 118/249; 118/258; 118/261; 118/262; 100/168; 100/169; 100/170; 100/176

[58] Field of Search ..... 118/114, 117, 212, 224, 118/249, 261, 262, 414, 258; 100/93 RP, 160, 162, 168, 169, 170, 176; 15/256.51, 256.52

[56] References Cited

U.S. PATENT DOCUMENTS

| | | | |
|---|---|---|---|
| 1,914,488 | 6/1933 | Cüsters | 118/249 |
| 2,352,040 | 6/1944 | Ungerer | 15/256.51 |
| 2,560,572 | 7/1951 | Haywood et al. | 118/262 |
| 3,245,377 | 4/1966 | Gettel | 118/249 |
| 3,640,203 | 2/1972 | Raab et al. | 118/261 |
| 3,701,335 | 10/1972 | Barnscheidt | 15/256.52 |
| 3,751,156 | 8/1973 | Szostak et al. | 118/637 |
| 4,294,187 | 10/1981 | Fogle | 118/244 |
| 4,499,825 | 2/1985 | Uno | 101/167 |
| 5,122,396 | 6/1992 | Rantanen | 118/262 |

FOREIGN PATENT DOCUMENTS 3436082 4/1985 Fed. Rep. of Germany .

OTHER PUBLICATIONS

Coating rod fact sheet from R.D. Specialities, reprinted from *Coating Equipment and Processes* by George L. Booth, Lockwood 1970.

*Primary Examiner*—W. Gary Jones
*Assistant Examiner*—Todd J. Burns
*Attorney, Agent, or Firm*—Herbert Dubno

[57] ABSTRACT

A web of flexible material is pressed between a counter-roll and a pressing roll to which the pressing force is applied by magnetic, fluid-pressure or switching means via a force-multiplying lever arrangement.

27 Claims, 7 Drawing Sheets

APPARATUS FOR PRESSING WEBS USUALLY IN CONTACT WITH A FLOWABLE SUBSTANCE

FIELD OF THE INVENTION

My present invention relates to an apparatus which can be used for the application of a liquid or other flowable substance to a web of flowable material, to an apparatus for squeezing a flowable substance from such a web, an apparatus for simply pressing a web, or an apparatus for carrying out two or more such operations in the treatment of paper, fabric or other flexible materials. The invention also relates to a method of operating such apparatus or a method of using such apparatus in the treatment of webs of flexible material.

BACKGROUND OF THE INVENTION

It is known to provide a system which consists of a counterroll and a pressing or working roll which is urged toward the counterroll and between which a web, strip, band or discrete sheets or pieces of flexible material can be passed.

Such systems are used in the printing or coating of fabrics, in the application of flowable substances such as viscous or pasty materials or liquids to such materials and even in the pressing of such materials to smooth them or remove wrinkles therefrom.

The term "web" as used herein is intended to refer to a continuous strip or band of a flexible material, e.g. paper, fabric, nonwoven fabric or the like to be impregnated, coated, printed or smoothed, as well as to individual pieces of sheet material which can be passed in succession between the counterroll and the pressing or working roll, to strip materials and pieces of material entrained on a continuous carrier or belt between rolls and, to in general, material which can have a substantial width and which can be subjected to pressing between the rolls, i.e. materials having a relatively small thickness and a certain degree of flexibility to allow them to be impregnated or coated with the flowable substance, to allow the flexible substances to be pressed from the material or to allow the material to be pressed even in the absence of a flowable substance.

The term "flowable substance" as used herein is intended to refer to any material capable of being squeezed from or into such a web, for coating the web or impregnating the web, e.g. for printing, dyeing, conditioning, sizing or otherwise treating the web.

In machines or apparatus of the type described, i.e. having a counterroll and a pressing or working roll between which the web can pass, it is not uncommon to provide the counterroll so that it has a relatively large diameter and is axially journaled, i.e. rotatably supported at its axis or shaft, preferably at a fixed location and has relatively high bending stability (resistance to bending).

The pressing roll or working roll may have a smaller diameter than the counterroll and be urged toward the latter. It also may have a relatively smaller bending stability, i.e. a reduced bending resistance by comparison to the bending resistance of the counterroll.

In the past, with such systems, problems have been encountered in applying the pressing force via the pressing roll against the web uniformly over the entire length of the contact region and thus the width of the web. By and large, the pressing force must be relatively small if it is to be uniform across the width of the web.

The greater the diameter of the pressing or working roll and the greater the length of the rolls and the operating width, i.e. the width of the web which may also be referred to as the machine width, the greater are collateral effects and the more significant is the variability in the uniformity of the pressing force to the point that it is difficult to ascertain precisely how the pressing force will vary across the machine width and what losses may occur in the transmission of force because of undesired bending of the pressing roll.

Indeed, it has been found that roll bending is an important factor which depends upon the type of roll, its dimensioning, the materials from which it is constituted and the stresses to which the roll is subject along the length, on variation of the pressing force. Roll bending also causes problems in maintenance, requires frequent repair, increases the down time of the apparatus and contributes to problems in operation thereof.

The nonuniformity of the pressing force can give rise to nonuniformities in the product across the width thereof as well.

Accurate linearity of the rolls and a precise cylindrical configuration of the peripheral surfaces and parallelity of two rolls can only be approximated in practice. The smaller the diameter of the working or pressing roll and the greater its length, the smaller will be the pressing force which can result in bending. However, the greater the bending resistance, the greater will be the force which may be diverted from the pressing force to be lost in bending of a roll.

It is recognized that high quality results which are uniform along the full width of the web, i.e. along the machine width, will depend upon the uniform application of the pressing force over the full length of the pressing roll.

The pressing force in the past has been generated predominantly by applying a radial force at the axis of the pressing roll in the direction of the counterroll. Because of the bending tendency of the working roll, this has not been found to be fully satisfactory.

OBJECTS OF THE INVENTION

It is, therefore, the principal object of the present invention to provide an improved pressing device which can be used for applying a flowable substance to the web, for pressing a flowable substance from the web or for simple pressing of the web, whereby drawbacks of earlier devices for such purposes can be avoided.

Another object of this invention is to provide an apparatus having a counterroll and a pressing or working roll whereby the effect of pressing-roll bending is minimized and high uniform pressing forces may be applied against the web.

Another object of the invention is to provide an apparatus of the type described which avoids the abovementioned drawbacks.

It is also an object of the present invention to provide an improved method of operating such an apparatus and/or pressing a web between the counterroll and the pressing roll whereby drawbacks of earlier methods are avoided.

SUMMARY OF THE INVENTION

These objects and others which will become apparent hereinafter are attained, in accordance with the present invention, in an apparatus in which the pressing roll is peripherally journaled or supported over its length and the machine width in at least one slide-bearing body or a plurality of such bodies arrayed along the pressing roll and cradling the latter or having planar or curved surfaces pressing against the periphery of the working roll opposite the line along which it bears upon the web, and providing a compression or tension force which is applied to that body by a force-multiplying lever arrangement with a mechanical advantage or force-multiplication ratio sufficient to generate high pressing forces which act uniformly upon the pressing roll and hence upon the web.

According to the invention, therefore, an apparatus for pressing a web of flexible material which can have a flowable substance in contact therewith, can comprise:

an axially journaled counterroll formed with a rotating surface having a relatively large diameter and relatively great resistance to bending for supporting the web against a pressing force applied thereto;

a pressing roll juxtaposed with the counterroll and adapted to press the web thereagainst, the pressing roll having a relatively small diameter substantially less than the diameter of the counterroll and a bending resistance smaller than that of the counterroll, the pressing roll having an axis free to move relative to the rotating surface;

surface-journalling means braced against a periphery of the pressing roll over substantially an entire width of the web for applying the pressing force thereto;

lever means including at least one bridge piece swingable about a fulcrum, and carrying the surface-journalling means for urging the surface-journalling means and the pressing roll toward the counterroll; and force-generating means acting upon the bridge piece at a location spaced from the fulcrum for generating the pressing force.

Preferably the web is pressed between at least one counterroll and a plurality of such pressing rolls in series, i.e. in a succession of such apparatuses by a method which comprises:

passing the web in succession through at least two pressing units and between at least one axially journaled counterroll formed with a rotating surface having a relatively large diameter and relatively great resistance to bending for supporting the web against a pressing force applied thereto, and, in each unit, a respective pressing roll juxtaposed with the counterroll and adapted to press the web thereagainst, the pressing rolls having relatively small diameters substantially less than the diameter of the counterroll and a bending resistance smaller than that of the counterroll, the pressing rolls having an axis free to move relative to the rotating surface with which the pressing roll is juxtaposed;

bracing the pressing roll of each unit toward the rotating surface with which the pressing roll is juxtaposed by peripherally engaging each pressing roll with at least one surface-journalling body slidably engaging a periphery of the respective pressing roll over substantially an entire width of the web for applying the pressing force thereto;

applying the pressing force to each of the bodies by a lever means including at least one bridge piece swingable about a fulcrum of the respective unit and carrying the respective body; and generating the force with a force-generating means assigned to each of the units and acting upon the bridge piece of the respective unit at a location spaced from said fulcrum of the respective unit.

The lever arrangement and the application of pressing or tensile forces thereto permits the force multiplication to be selected at will. With the arrangement of the invention, relatively small forces can be applied at the lever arrangement but because of the force multiplication, high pressing forces can be applied to the web by the pressing roll with high efficiency and through the use of relatively simple construction.

According to a feature of the invention, the force-generating means can include means for generating a magnetic field producing a tractive force such that the magnetic attractive force is converted into the pressing force of the pressing roll against the web.

The pressing force can be applied to the pressing roll in successive zones therealong by respective force-generating magnetic devices arrayed along a single bridge piece or applied to a plurality of individual bridge pieces which are arrayed along the pressing or working roll.

The magnetic force-generating means has an advantage over pneumatic or hydraulic force-generating means, which can also be used in accordance with a feature of the invention, in that the pressing force can be directly generated electrically and will react correspondingly quickly to control pulses.

Such magnetic forces can be easily subdivided into respective pressing zones and the control may be applied in a zone-wise manner to all of the zones in common. The system of the invention, therefore, can be readily subjected to automation. By comparison with pneumatic or hydraulic pressing devices, the magnetic-force generating pressing system has the advantage that the electromagnetic force generation can be effected without significant moving parts and can be completely maintenance-free.

However, when the apparatus is to be used in an explosive environment, i.e. when antiexplosion protection is desirable, we can employ pneumatic or hydraulically effective pressing-force generators, this configuration of the force-generating means enabling, selectively, the application of pulsed forces to the lever arm. The electromagnetic force is preferably generated as a tractive force.

In the case of limited space, instead of a long lever arm, two additively effective shorter lever arms may be used. In this case, the tractively effective magnetic force can also be transformed into an impulsively-acting lever force acting upon one of the levers.

The generic apparatus of the invention can be employed in any conceivable spatial arrangement which can be varied depending upon the particular function.

According to a further feature of the invention, between the magnetic field generating device and the part to which the magnetic force is applied, there is a gap whose width can be varied by an adjustment device.

Within this gap, according to a further feature of the invention, a preferably compression-elastic deformable strip (bumper or shock absorber or impact damper) of preferably nonmagnetizable material can be introduced which prevents magnetic adhesion of the two relatively movable parts which magnetically may adhere to one another. When a thickened region of the web, however, results in a foreign object entrained thereby, a stitched seam or other thickened part of the web itself traverses the nip between the rolls, the force-transmitting lever arm can thus yield and will have a certain amount of play within the compressibility of this strip or afforded by the lack of magnetic adhesion of the two relatively movable parts to one another.

The adjustability of the gap width allows an adjustment of the pressing force independently of magnetic field variation, electromagnet current variation and the like. It may also be advantageous, according to the invention, to provide auxiliary devices which are effective magnetically to vary the gap width and which may be used for all of the magnetic devices arrayed along the pressing roll in common or which can be provided only for individual magnetic devices. The slide-bearing body which is braced by the bridge piece or lever means against the pressing roll and which bears against the periphery of the pressing roll ca be formed in one piece or as a multipartite body and can have one or more planar or concave surfaces bearing upon the pressing roll generally tangentially. The sliding and pressing body can thus be replaced in one piece or the parts thereof can be replaced when, for example, it is necessary to change over the pressing roll for a pressing roll of a different diameter or to replace the coating on the pressing member or members.

The pressing roll can be composed of any desirable material and itself can be one piece or a plurality of pieces disposed in succession across the machine width and thus the width of the web to be pressed. In an advantageous embodiment of the invention, the width of the machine can be subdivided in a succession of zones transversely of the web, each of these zones having a respective bridge piece connected on a respective force-generating means and swingable about a respective fulcrum. All of the fulcra of these bridge pieces can be mounted upon a common support girder and each bridge piece can bear upon a respective slide-bearing body which peripherally engages a one-piece pressing roll or a pressing roll similarly divided into sections along its length so that each body engages a respective discrete section of the pressing roll.

Various modifications are possible. For example, the lever means can be formed by a single bridge piece extending the full machine width and a plurality of force generators can be spaced along this one-piece bridge piece. The one-piece bridge piece can act upon a one-piece bearing body or bearing body subdivided along the machine width. Alternatively, a plurality of bridge pieces can act upon a single bearing body. A plurality of bearing bodies can act on a one-piece pressing roll or upon a pressing roll divided along its length or a plurality of bearing bodies can act upon one-piece pressing roll or upon respective pressing roll segments of a longitudinally-divided pressing roll.

The pressing roll can be entrained peripherally, i.e. can have a peripheral drive, or can be axially driven and the rolls can be driven with the same or different peripheral speeds and in the same sense or in opposite senses.

Either roll may be driven at a speed which is the same as, greater than, or less than the peripheral speed of the other roll.

When required, the pressing roll can be formed as a squeezing roll which can bear upon the web of material after it has been immersed in a flowable substance. Alternatively, it may have a moving roll or a roll serving to meter a flowable substance onto the web. Corresponding to the particular function, it may have different diameters and different hardnesses and surface characteristics. The surface of the pressing roll can be structured, i.e. provided with irregularities in patterning and alternating lands and troughs or depressions. The surface of the drum or at least the surface zone thereof can be compression-elastic, e.g. composed of rubber or another elastomer or be both compression-elastic and bibulous for fluid transfer between the surface of the pressing roll and the web. In the latter case, the surface of the pressing roll may be composed of felt.

When the pressing roll is used as an applicator roll for applying a flowable substance such as a liquid to the web, a liquid-supply system may be provided. The liquid-supply system may include a trough in which the applicator roll can be immersed or can include a liquid-feed gap connected to a source of the flowable substance.

According to a feature of the invention, a stripper which may be compression elastic or spring-biased against the pressing roll, can engage tangentially thereagainst or can be disposed thereagainst so that it provides a one- or two-edged shaving action. The stripper can lie against the pressing roll in the sense of rotation thereof to have a metering effect controlling the quantity of flowable substance applied to the web or can be oriented counter to the sense of rotation to remove the flowable substance from the pressing roll, i.e. to clean the latter.

Preferably a cleaning shaving stripper is so provided that this stripper and any stripper for metering the flowable substance onto the pressing roll can be easily cleaned.

According to a further feature of the invention, two or more pressing devices can be provided in succession to operate upon the web, whether these devices act as squeezing devices, or as applicator devices or as smoothing devices or in any combination. Each of these units may have a respective counterroll, although the counterroll may be common to two or more such units. The units may have the same or different functions.

The counterroll can be a deflecting roll of a textile or carpet-printing machine and can be used following an immersion bath or for application of a flowable medium for dyeing, moisturizing and then dyeing, squeezing dye from the carpet, etc.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
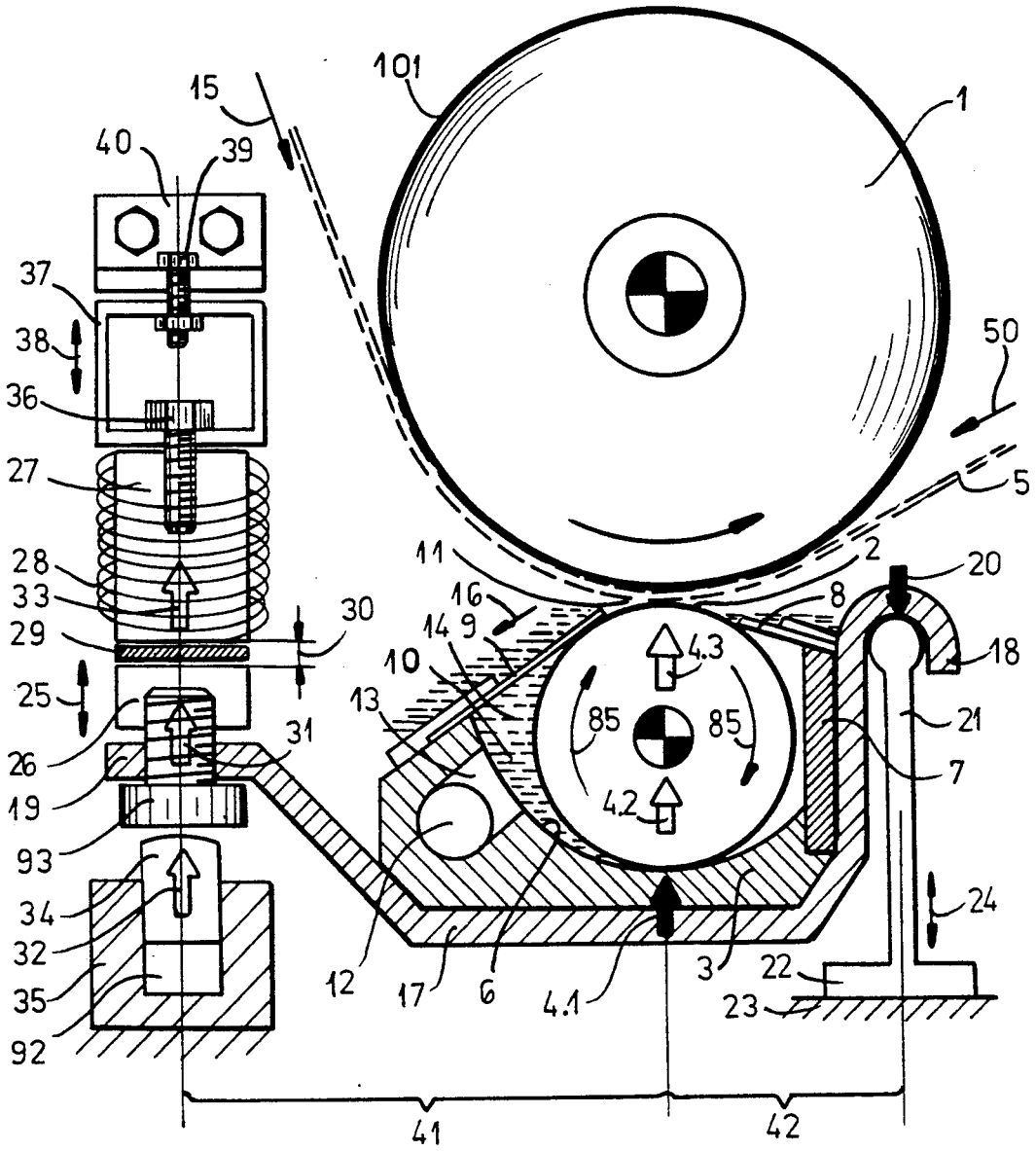
FIG. 1 is a diagrammatic transverse cross-sectional view taken in a plane parallel to the direction in which the web passes, illustrating an embodiment of the invention.

FIG. 1 has been devised so that it illustrates a number of features of the present invention which can be utilized together or separately. It will be understood that the system of the invention can be employed for application of a flowable substance to the web, for squeezing a flowable substance from the web, for pressing and smoothing a web with or without a flowable substance, and for any combination of these processes. Certain features illustrated in FIG. 1 may be omitted depending on how the device is used. For example, in FIG. 1 I have shown a trough to which a flowable medium may be fed for application to the web. A trough provided with a drain may be used in a squeezing operation for removing excess flowable substance from a web and the trough may be avoided entirely if a simple pressing operation is to be undertaken.

While the lever mechanism shown may extend the full machine width and thus the full length of the pressing roll 2 in this Figure, it is also possible to subdivide the lever means into zones, each of which may have a bridge piece 17 (FIG. 1A) and can carry a respective pressing body 3 to bear upon a continuous pressing roll 3 or one that is also subdivided into zones.

Figure 2:
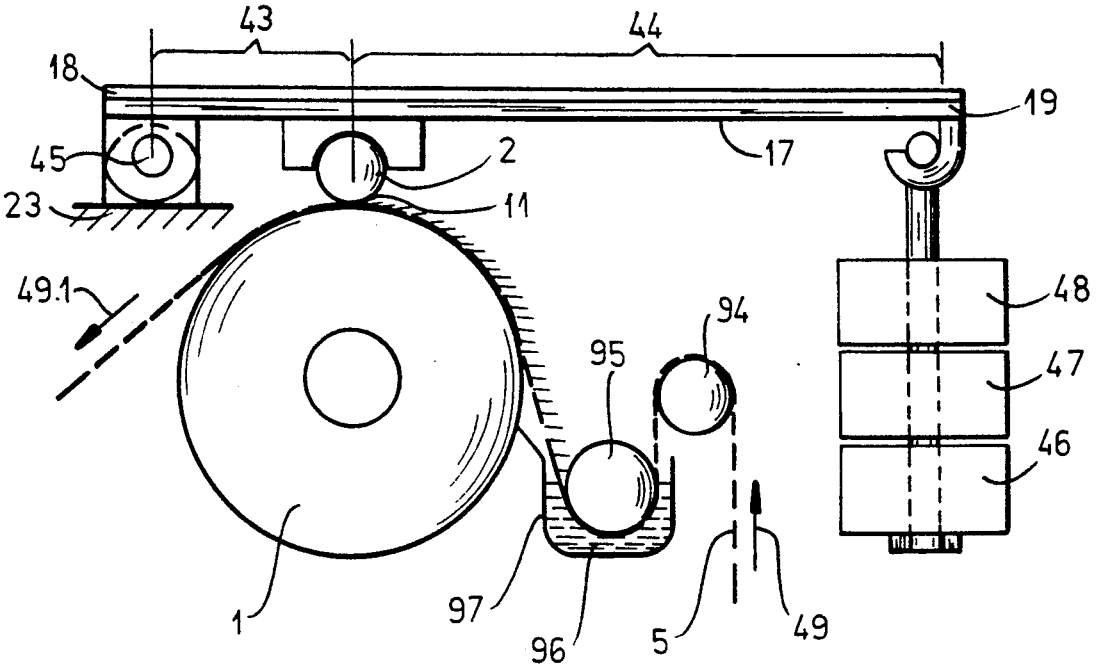
FIG. 2 is a similar view of an apparatus for squeezing a flowable substance from a web to which the flowable substance has been applied by immersion.

FIG. 2 demonstrates generally that the orientation of the pressing roll can be varied. For example, in FIG. 1 the pressing roll 2 is shown to engage the web and the counterroll 1 from below whereas in FIG. 2 the pressing roll 2 engages the web and the counterroll 1 from above and the lever mechanism is biased by a tractive force generated by weights as compared to a tractive force generated by a magnetic-force generator in the case of FIG. 1.

Throughout FIGS. 1–6, in a similar way, elements of one embodiment may be substituted for correspondingly functioning elements of another embodiment depending upon the specific function of the particular apparatus or device. The functions will be abbreviated as function A for application of a flowable substance to the web and as function Q for the squeezing or pressing function. In FIG. 1 I have shown an apparatus which comprises an axially-journaled, preferably fixedly-positioned counterroll 1 of relatively large diameter and relatively large bending stability and resistance to bending. It is conceivable to substitute for this counterroll 1 a nonrotating counter-pressure body whose cross section can be identical to that of the counterroll 1 and which can be formed with a rounded slidable surface 101 which, in the case of a counterroll is a rotating surface.

It also may be possible to provide, instead of a rounded surface 101, a planar surface which can be considered to be a surface of an infinite radius of curvature, with appropriate modification of the spatial arrangement of the other elements of the embodiment of FIG. 1.

Beneath the counterroll 1, a so-called pressing or working roll 2 is provided whose diameter is substantially smaller than the diameter of the counterroll 1.

This pressing roll 2 is not axially journaled, but rather is peripherally supported in a slide-bearing body 3, which as described, may be formed in one or more parts and which is braced in the direction of the arrows 4.1, 4.2, 4.3 against the pressing roll 2 and the counterroll 1. The pressing roll itself may be provided as a one-piece pressing roll or in distinct segments. The pressing roll 2 is urged against a web 5 which thus is pressed between the roll 2 and counterroll 1.

Figure 6:
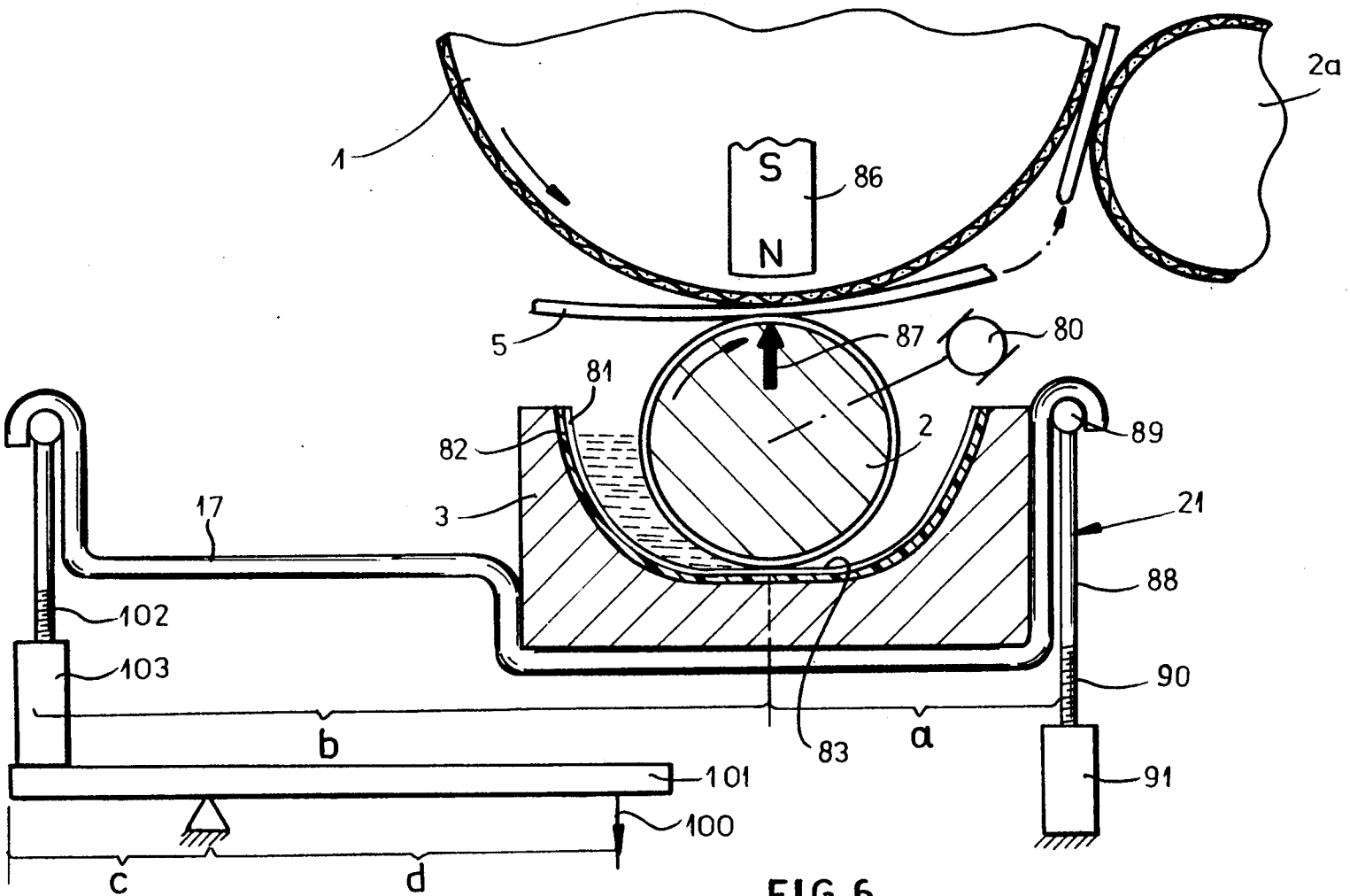
FIG. 6 is a diagram illustrating a two-lever arrangement for the force multiplication.

In the embodiment shown in FIG. 1, the pressing roll 2 is peripherally entrained by the rotation of the counterroll 1 and the frictional relationship between the rolls and the web. I can, however, provide an axial drive 80 for the pressing roll 2 as shown in FIG. 6, to enable the pressing roll 2 selectively to be driven at the same peripheral speed as the counterroll 1, a greater peripheral speed than the counterroll 1 or a smaller peripheral speed than the counterroll 1 or in a sense opposite the sense of rotation of the counterroll I or in the same sense as the sense of rotation of the counterroll 1.

The slide-bearing body 3 is provided with a sliding surface 6 which has a concave curvature in the embodiment of FIG. 1 and partly cradles the pressing roll 2. The sliding surface 6 can, however, have a different configuration from that shown in FIG. 1. For example, as is seen in FIG. 6 for the pressing body 3, the sliding surface can be provided with grooves 81, e.g. in an antifriction coating 82 which can be formed replaceably on the surface of the trough formed by the body 3. This coating can be composed of polytetrafluoroethylene.

Rather than a fully curved shape, the surface in contact with the pressing roll 2 may have a planar configuration as illustrated at 83 and can be tangential thereto. In general, therefore, it can be said that the sliding surface can be grooved or fluted and can be used in combination with curved and fluted parts, for example, the part 7, to prevent undesired lateral movement of the pressing roll 2 which can have grooves or flutes preventing accumulation of contaminants between the pressing roll 2 and contact surfaces of the bar 7 for the surface 6 therewith.

Regular removal of residues of substances from the surface of the pressing roll 2 or contaminants adherent thereto can be effected with a shaving-type stripper 8 whose edge is turned into the direction of rotation of the pressing roll as represented by the arrows 85. This stripper 8 serves as a scraper blade for removed adherent materials from the surface of the pressing roll 2.

The opposite side of the pressing roll 2 can cooperate with a stripper 9 which rides upon the upper rising quadrant of the pressing roll 2 and serves to control the amount of fluid substance upon the roll 2 and carried by the latter to the web 5.

This stripper can be flat, can rest against the roll 2 tangentially and can bear under a spring force thereagainst. The spring may be constituted by the blade 9 itself. Of course, the stripper 9 can also be similar to stripper 8 but somewhat smaller and can have an edge which bears against the outer surface of the pressing roll 2.

If a stripper 9 is used, it can have a variety of functions. For instance, it can have a metering function limiting the quantity of material 10 to be coated onto the web 9 and held back in the trough 14 by this stripper. The trough 14 is here defined by the surface 6 and the stripper 9 can limit the flowable material on the roll 2 to that which is adherent thereto.

Thus the amount of the flowable material which is entrained into the contact or pressing zone is limited.

The surface characteristics of the pressing roll 2 or the characteristics of a sheath or coating provided on the pressing roll 2 can determine the amount of the flowable substance which is entrained onto the web 5. The pressing force developed in the direction of the arrows 4.1, 4.2 and 4.3 and the resultant working pressure in the nip 11 between the rolls, determines both the coating intensity and the coating uniformity and especially the depth of penetration of the coating substance into the web 5. The coating substance 10 can be delivered to the compartment 14 by, for example, a tubular passage 12 in the body 3 and connecting openings 13 which terminate in the surface 6. The apparatus illustrated in FIG. 1 thus is able to perform a coating or application function A.

If the apparatus is to be used in function Q, the coating substance 10 is not supplied through the passage 12 and 13 into the compartment 14 but rather the coating fluid, i.e. the flowable substance, is assumed already to be present in the web 5 which is fed in the direction of arrow 15 through the nip between the rolls. The pressing in the region of the nip 11 between the two rolls 1 and 2 squeezes out flowable substance from the web and the squeezed out material flows by gravity into the compartment 14 from which it can be carried off through the openings 13 and the passage 12. Where the stripper 9 is used, the squeezed out fluid can pass along the stripper 9 as is represented by the arrow 16.

For the function Q, it has been found to be advantageous that the working roll 2 is driven peripherally in the region 11 by entrainment with the roll 1 or by an axial drive with the same, with a greater or with a smaller peripheral speed.

It has been found to be advantageous, moreover, to supplement the force with which the pressing roller is urged toward the counterroll 1 with a magnetic attractive force applied between the two rolls directly. In that case, as can be seen from FIG. 6, a magnetic beam 86 is provided within the roll 1 and attracts the roll 2 which is here composed of ferromagnetic material so that it is drawn by the magnetic attraction force 86 against the web 5.

According to another feature of the invention, even without providing an axial drive in and for the pressing roll 2, a slow down in the rotation of the pressing roll 2 can be effected by the provision of a magnetic attractive force as described drawing the pressing roll against the counterroll.

Control of the rotary speed of the pressing roll can also be effected by regulating the pressing of the surface 6 in the direction of arrow 4.1 in a controlled manner. By and large the same friction effect can be obtained as with a braked axial drive for the pressing roll 2. The slide bearing and pressing body 3 is braced against the bracing roll 2 by the bridge piece 17 which has a pivot support region 18 and a force-applying region 19. The support region 18 in the operating state rests upon the force-receiving part 21 which defines the fulcrum and is connected via a base 22 to a girder 23. The girder 23 is mounted on the machine frame.

The girder 23 is adjustable in the direction of arrow 24, i.e. toward and away from the surface 101 of the counterroll 1 and thereby permits positioning of the folcrum.

The force-receiving part of the bridge piece 17 can be moved in the direction of arrow 25. By shifting from the rest position, movement is effective in the direction of the arrow 31.

The means for adjusting the fulcrum 21 can include, as can be seen from FIG. 6, a rod 88 carrying the fulcrum head 89 and threaded at its lower end 90 into a stationary threaded sleeve 91 so that, with a rotation of member 88 in one or the other sense, the fulcrum can be raised and lowered as represented by the arrow 24 previously mentioned.

The pressing force represented by the arrows 4.1, 4.2, 4.3 is applied to the bridge piece 17 in the region 18 thereof by a force-generating system which can apply a pressing force 32 or a tensile force 33 to displace the bridge piece in the direction of arrow 31 relative to the counterroll 1 and the web 5 pressed thereagainst.

The pressing force 32 is generated by pressurizing a compartment 92 in a cylinder 35 with compressed air or pressurized hydraulic medium to displace the piston 34 in the direction of the arrow 32. The force 33 is applied by magnetic means that will be described in greater detail hereinafter.

While the movement of the roll 2 toward the counterroll 1 by the bridge piece 17 is limited by the degree to which the web 5 can be compressed, a second limitation on the mobility of the bridge piece 17 in this direction is provided by the gap width 30, between a magnetically attractable member 26 and the electromagnet 27 generating the magnetic force. Within this gap, a compression elastic or compressible strip 29 can be provided. This strip can be loose as shown in FIG. 1 or attached to one part 26 or the other part 27 defining the gap.

It will be appreciated, of course, that member 26 affixed to the bridge piece 17 can be formed as an electromagnetic member and can be juxtaposed with a magnetically attractable body 27 in a kinematic reversal of the structure shown.

The part 26 can be a bar of magnetizable steel which is connected by a fastening screw 93 to the region 19 of the bridge piece 17. The screw 93 serves as a device for adjusting the distance between the parts 26 and 27 and thus the gap width 30.

Both of the force-generating devices 34/35 and 26/27 can be used selectively alternatively or can be used in combination depending upon the pressing force which is to be applied in the region 19 of the movable bridge piece 17.

If the pressing force is to be generated only by the magnetic unit 26/27, the parts 34 and 35 can remain functionless and at rest. The screw 93 can then be supported on the stationary piston 34 until the magnetic field is applied by the electromagnet 27.

The electromagnet 27 is mounted by a screw connection 36 to a support beam 37 whose position can be adjusted as represented by the arrow 38 by an adjusting device such as a screw arrangement 39 connecting the beam 37 to the bracket 40 of the apparatus.

The bracket 41 represents the distance a between the location at 19 at which the force-generating means applies the forces 32, 33 to the lever means 17 and the location 4.1, 4.2, 4.3 at which the lever means applied the force to the pressing roll 2 while the bracket 42 represents the distance between the fulcrum and the point at which the force is applied by the body 3 to the pressing roll 2.

The distance a represented by the bracket 41 and the distance b represented by the bracket 42 are in the relation $b=0.5a$, establishing a ratio of the distances b:a of 1:2. The ratio of the force applied to the roll 2 by the body 3 to the force applied by the force-generating means and represented at 32/33 is thus 3:1, corresponding to a force multiplication of three times. In the embodiment of FIG. 2, a force multiplication of four times is provided since the distances 43 and 44 are in a ratio of 3:1 and thus the force is applied at a distance from the fulcrum which is four times the distance between the fulcrum and the point at which the lever system applies the force to the pressing roll 2. The maximum force multiplication should be 1:10.

In the embodiment of FIG. 2, instead of a fulcrum upon which the bridge piece or lever can rest, the fulcrum is formed by a fixed pivot 45 supported in the region 43 of the apparatus.

FIG. 2 also shows that the device can be arranged with a 180° offset from the apparatus of FIG. 1, i.e. that the pressing roll 2 can engage at the apex of the counterroll 1 from above. In the region 19 of the lever, i.e. the region at which the force is applied thereto, I have shown weights 46–48 to be suspended from the lever arrangement 17, thereby demonstrated that weighting can be used as a force-generating means.

FIG. 2 also illustrates a function of the apparatus in which a fluid is squeezed from the web 5. Prior to passing through the nip 11 between the rolls 1 and 2, the web passes in the direction of the arrow 49 over a guide roller 94 and around an immersion roller 95, leading the web through a bath 96 of the flowable substance in an immersion trough 97. Thus when the web passes through the nip 11, excess flowable substance will be squeezed therefrom so that the web 5 passing the nip will have the desired residual moisture content.

Following the apparatus of FIG. 2 in the direction of travel 49 and 49.1 and as represented by the arrow 50 in FIG. 1, an apparatus similar to that shown in FIG. 1 can be provided, thereby indicating that a succession of pressing units employing the principles of the present invention may be used.

In this mode of operation, a two or more stage coating process may be provided. For example, the apparatus of FIG. 1 can be operated in a coating mode A and can be followed by another apparatus of the type shown in FIG. 1 carrying out a squeezing function Q. Alternatively, the apparatus of FIG. 1 operated in a coating or application mode A can be followed by an apparatus as shown in FIG. 2 operated in a squeezing mode Q.

The apparatus of FIG. 2 can be operated in an initial squeezing mode Q and can be followed by a coating apparatus as shown in FIG. 1. Both apparatuses can be operated in the same mode. When the first apparatus is set for the operating function Q, the second apparatus should operate with a pressing force less than that of the first. When the first unit is operated in A mode, the pressing force in the second unit (A or Q) should as a maximum be equal to that of the first unit so that the flowable substance should not additionally be pressed from the web.

A multistage operation can be effected also as diagrammed in FIG. 6, where along a single counterroll 1, a plurality of pressing rolls 2, 2*a*, etc. successively engageable with the web 5 can be provided and each pressing roll urged by a respective lever arrangement against the web. The first pressing roll may coat while the second squeezes or vice versa as has been described by the various combinations as referred to above. The pressing force in the region 11 can derive from adjustment of the gap width 30 or the force applied by the hydraulic means 26/27 or the force applied pneumatically or hydraulically at 34/35 or varying combinations thereof.

The force can be applied uniformly over the length of the pressing roll 2 either through the application of a single body 3 thereagainst or by the application of zones of such bodies thereagainst over the length of the pressing roll 2. The provision of the additional magnetic force-generating system within the rolls as described in connection with FIG. 6 can eliminate the difference in pressing forces at the pressing roll 2 which may result from variations in the thickness of the web.

By adjustment in the direction of arrow 38, I can set the parts of the magnetic system so that they can compensate for any thickness of the material of web 5 such that for a given magnetic field strength, the same pressing force will be generated.

Figure 1A:
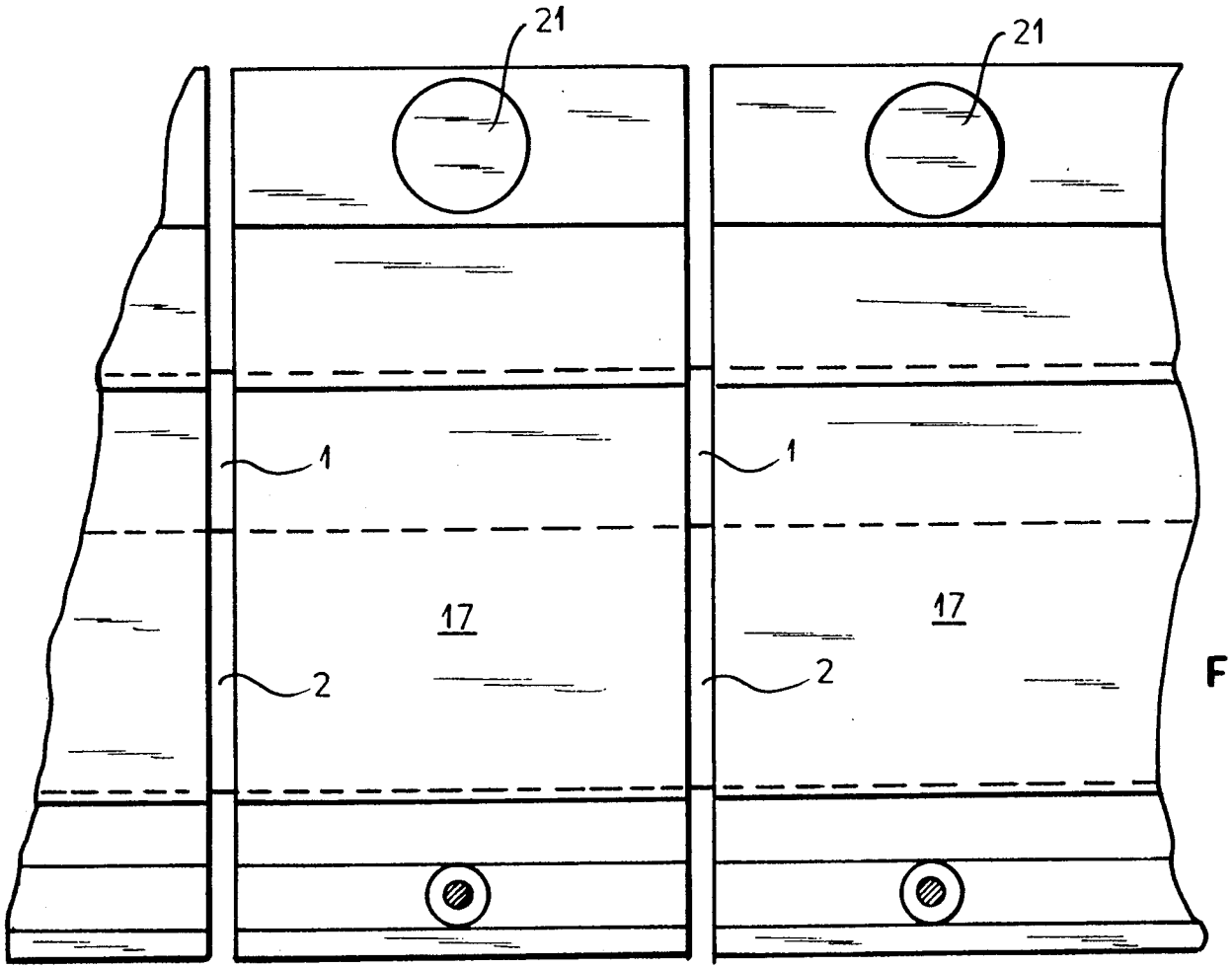
FIG. 1A is a bottom view of the array of bridge pieces of the invention, illustrating a system in which a succession of zones is provided along the pressing roll to apply the pressing force thereto.

From FIG. 1A it will be apparent that the devices 17, 93, 26, 27, 34 and 35 as well as elements 21 and 45 are provided in succession along the pressing roll to apply the force in zones to the latter.

The coating 82 of the surface 6 can have limited bending resistance so that at the application of high pressing forces, the coating will not resist a bending action. The body 3 may also be subdivided into a plurality of bodies along the length of the pressing roll 2 as long as the spacing between the individual segments is sufficiently small that the pressing roll 2 will not bend between two successive segments.

Figure 3:
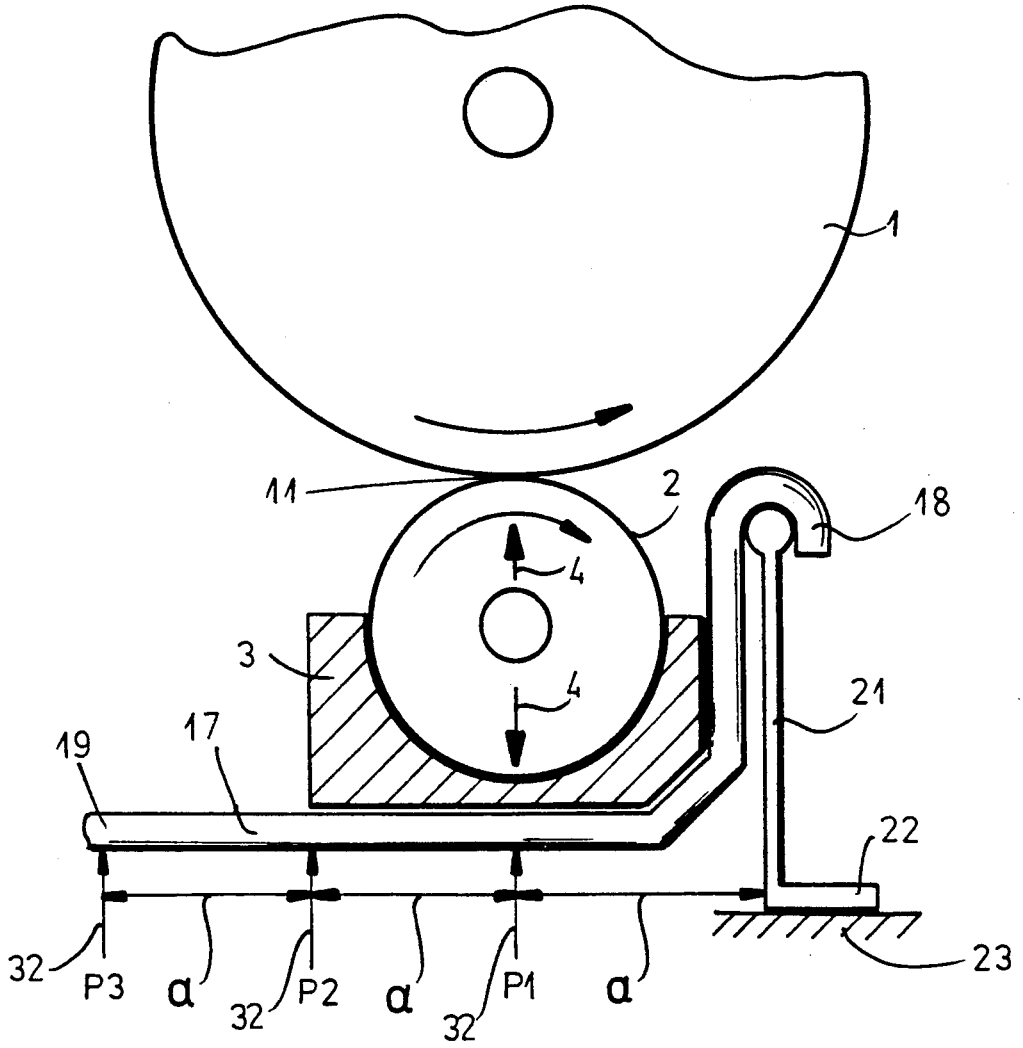
FIG. 3 is a transverse section of another embodiment of the invention.

FIG. 3 shows a system which is generally similar to FIG. 1 with a somewhat modified configuration of the bridge piece 17 and the extension 19 to which the force-generating means is applied. The force-generating unit 34, 35 has not been illustrated although the pressing forces are represented by the arrows 32. Thus arrows represent forces $P_1$, $P_2$ and $P_3$ to illustrate that the force application can be effected at different locations along the bridge piece. The force application location will here be understood to be effected at either $P_1$ or $P_2$ or $P_3$, depending upon the force desired at the nip 11.

It is also possible to make the bridge piece 17 and the force-application location 19 on telescopingly interconnected parts to vary the distance from the fulcrum at which the force is applied.

Depending upon the force P which is applied and the location, therefore, I am able to vary the force applied to the pressing roll 2 and by the pressing roll to the web (not seen in FIG. 3) against the counterroll 1. The pressing force can be adjusted either by changing the force applied or the distance from the fulcrum at which the force is applied.

Figure 4:
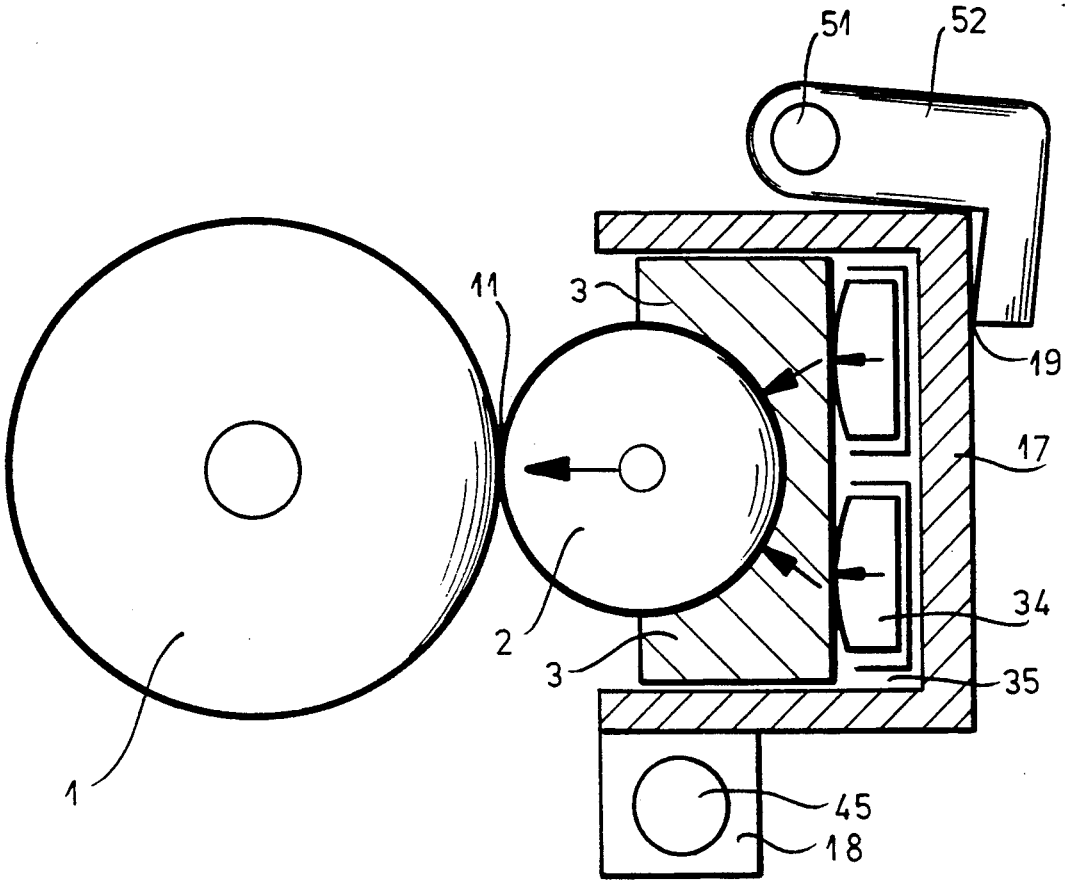
FIG. 4 is a cross sectional view of an embodiment in which a different type of lever arrangement is employed.

FIG. 4 shows an arrangement in which the pressing roll 2 is engageable with the web at a location swung through 90° from that of FIGS. 1–2. The bridge piece 17, 19 is U shaped and the region 19 is located closer to the bearing and pressing body 3 than in the embodiments of FIGS. 1–3. The compression force is applied by piston units 34, 35 located between the parts 3 and 17, 19. The bridge piece 17, 19 is connected by the part 18 with a fulcrum or pivot 45 and the lever position is held by detent 52 which can be swung out of the way to relieve the force upon the pressing roll 2.

Figure 5:
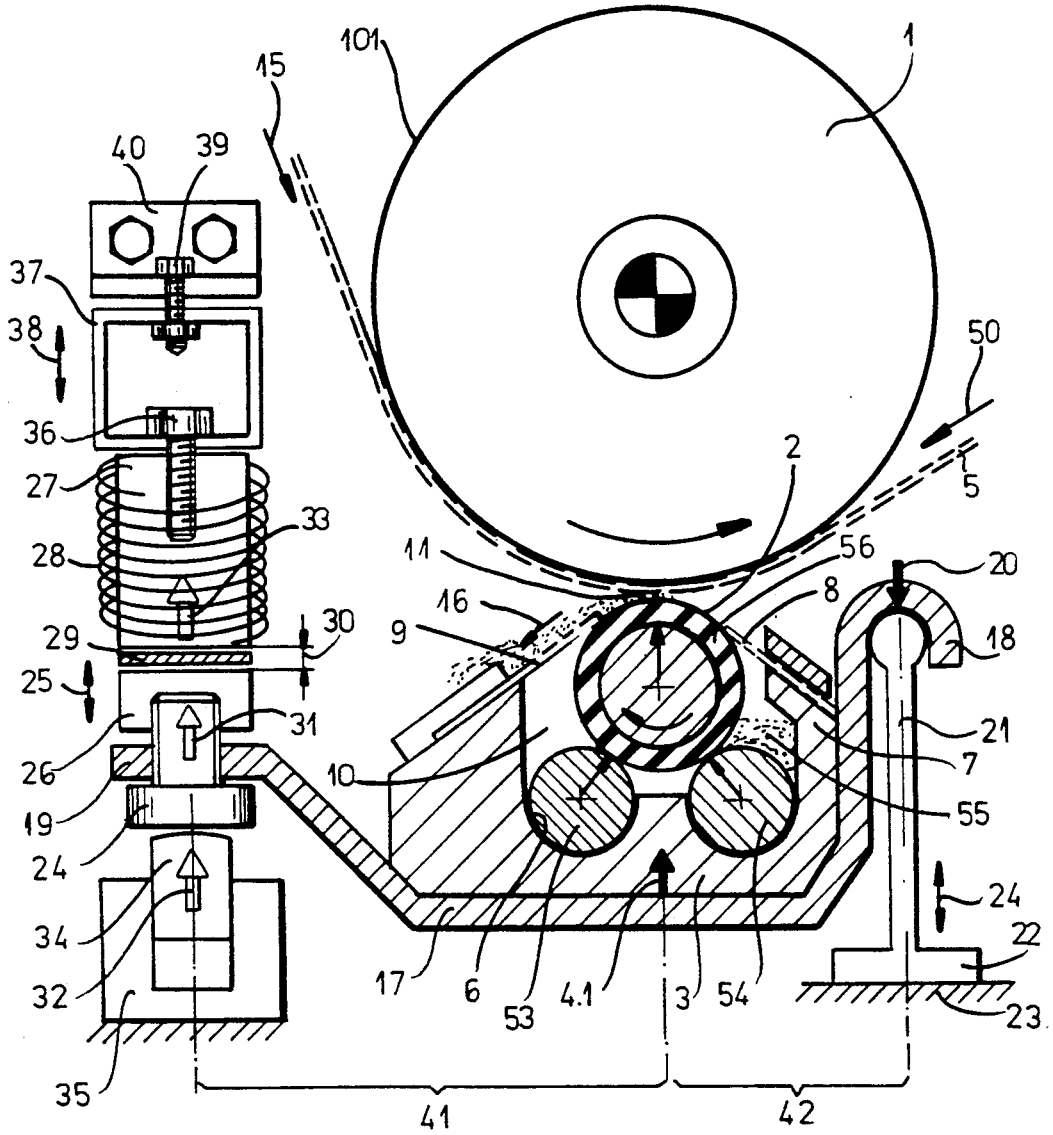
FIG. 5 is a cross-sectional view showing a modified system for supporting the pressing roll.

In the position shown in FIG. 4, the pressing roll is urged by the force-generating units 34, 35 in the direction of the counterroll 1. FIG. 5 shows an embodiment in which the pressing or working roll 2 is not engaged directly by the bearing body 3 but rather is braced toward the counterroll 1 by two rolls 53 and 54 peripherally journaled in the slide-bearing body 3 directly. This embodiment allows the pressing roll or working roll 2 to be provided with a coating or covering which has only limited sliding characteristics or limited wear resistance but which is compressible and on this basis or for other reasons cannot directly slide on the body 3.

If the compartment 55 is filled with a flowable substance to be applied to the web and the working roll 2 is sheathed in a compressible bibulous shell 56, this sheath 56 can take up the flowable substance in the space 55 and in the gap in which the sheath 56 is squeezed against the web, the flowable substance can be applied thereto. Excess flowable substance can be squeezed off against the roll 54 and thus a portion of the squeezed off liquid can be maintained in the compartment 55. The remainder is transferred to the web 5.

In the embodiment of FIG. 5, a roll 54 can perform at least part of the function of the stripper 9 so that the stripper 9 and stripper 8 may no longer be necessary although they have been shown in FIG. 5 in addition. The roll 54 is compressed with a force half that of the force with which the roll 2 presses on the counterroll in the region 1 for precise control of the pressing force and the coating effectiveness.

As can be seen from FIG. 6, a compound lever system may be employed in which the lever 17 receives the force from a force-generating means represented by the arrow 100 via another lever 101 which can have a ratio d:c providing an additional mechanical advantage. Adjustment of the lever 17 can be effected by the rotation of a rod 102 carried by the lever 101 in a sleeve 103.

I claim:

1. An apparatus for applying a flowable substance to or squeezing a flowable substance from a web of fabric, comprising:

an axially journaled counterroll of relatively large diameter and relatively large bending resistance;

a peripherally supported pressing roll having an axis parallel to said counterroll, a diameter substantially smaller than that of the counterroll and a bending resistance less than that of said counterroll, said pressing roll being juxtaposed with said counterroll so that said web passes between said pressing roll and said counterroll;

a peripheral bearing and pressing body formed in at least one piece and extending along said pressing roll and bearing peripherally thereon to press said pressing roll against said web and said web against said counterroll;

a bridge member formed in at least one piece and extending along a length of said pressing roll, receiving said peripheral-bearing and pressing body and supported on one longitudinal side thereof and engaged by at least one element bracing said bridge member along an opposite longitudinal side thereof; and at least one force-generating unit acting upon said bridge member and urging said body against said pressing roll, said bridge member being supported along said one longitudinal side by at least one pivot on a force-takeup element and said bridge member being pivotally movable about said pivot relative to said force-takeup member.

2. The apparatus defined in claim 1, further comprising means for adjusting a position of said pivot relative to said force-takeup member in a direction toward and away from said counterroll.

3. The apparatus defined in claim 1, wherein said bridge member is formed with a region spaced from said pivot upon which said force generating unit acts with a lever action applying force to said pressing body and said pressing roll.

4. The apparatus defined in claim 3 wherein said bridge member provides a force multiplication by lever action for the application of force to said pressing body which ranges from a minimum of 1:2 to a maximum of 1:10.

5. The apparatus defined in claim 1 wherein the force generated by said at least one force generating unit is applied to said pressing roll in zones adjacent one another distributed over the length of said pressing roll.

6. The apparatus defined in claim 1 wherein said force generating unit acts upon said bridge member at said opposite longitudinal side thereof and includes means generating a magnetic force field.

7. The apparatus defined in claim 1 wherein said force generating unit acts upon said bridge member at said opposite longitudinal side thereof and includes means generating a fluid pressure force field.

8. The apparatus defined in claim 1, further comprising adjustment means for shifting said force generating unit relative to said bridge member.

9. The apparatus defined in claim 1, further comprising means for driving said pressing roll in a sense opposite to the sense of rotation of said counterroll.

10. The apparatus defined in claim 1 wherein said pressing body is formed with a jacket of a material selected from the group which consists of easily bendable materials, materials of low friction and materials of high wear resistance.

11. The apparatus defined in claim 1 wherein said pressing body has a surface formed with at least one groove.

12. The apparatus defined in claim 1 wherein said pressing body has a surface with a concave configuration juxtaposed with said pressing roll and partly enclosing same.

13. The apparatus defined in claim 1 wherein said pressing body has a flat surface bearing against said pressing roll.

14. The apparatus defined in claim 1 wherein said pressing body has a surface juxtaposed with the pressing roll and forming a combination of a flat section and a concave section.

15. The apparatus defined in claim 1 wherein said pressing body forms a trough containing said flowable substance.

16. The apparatus defined in claim 1 wherein said pressing body forms a trough containing said flowable substance, and said pressing body is formed with a passage for said flowable substance and at least one opening connecting said passage with said trough.

17. The apparatus defined in claim 1 wherein said pressing body is formed in one piece all along the length of said pressing roll.

18. The apparatus defined in claim 1 wherein said pressing body is subdivided into a plurality of pieces along said pressing roll.

19. The apparatus defined in claim 1, further comprising at least one strip bearing upon said pressing roll for stripping said flowable substance therefrom.

20. The apparatus defined in claim 1, further comprising a bibulous compressible jacket on at least one of said rolls.

21. The apparatus defined in claim 1 wherein said pressing roll is formed with a structured surface.

22. The apparatus defined in claim 1, further comprising magnetic means drawing said pressing roll toward said counterroll for reinforcing the force with which said pressing roll presses against said web.

23. An apparatus for applying a flowable substance to or squeezing a flowable substance from a web of fabric, comprising:

an axially journaled counterroll of relatively large diameter and relatively large bending resistance;

a peripherally supported pressing roll having an axis parallel to said counterroll, a diameter substantially smaller than that of the counterroll and a bending resistance less than that of said counterroll, said pressing roll being juxtaposed with said counterroll so that said web passes between said pressing roll and said counterroll;

a peripheral bearing and pressing body formed in at least one piece and extending along said pressing roll and bearing peripherally thereon to press said pressing roll against said web and said web against said counterroll;

a bridge member formed in at least one piece and extending along a length of said pressing roll, receiving said peripheral-bearing and pressing body and supported on one longitudinal side thereof and engaged by at least one element bracing said bridge member along an opposite longitudinal side thereof; and at least one force-generating unit acting upon said bridge member and urging said body against said pressing roll, said force-generating unit comprising two magnetically attractable parts having a gap between them.

24. The apparatus defined in claim 23, further comprising means for adjusting a spacing of said gap.

25. The apparatus defined in claim 24, further comprising means for adjusting a spacing of said gap in dependence upon a thickness of said web.

26. The apparatus defined in claim 23, further comprising an elastic strip forming a cushion in said gap.

27. An apparatus for pressing a web of flexible material which can have a flowable in contact therewith, said apparatus comprising:

an axially journaled counterroll of formed with a rotating surface having a relatively large diameter and relatively great resistance to bending for supporting said web against a pressing force applied thereto;

a pressing roll juxtaposed with said counterroll and adapted to press said web thereagainst, said pressing roll having a relatively small diameter substantially less than the diameter of said counterroll and a bending resistance smaller than that of said counterroll, said pressing roll having an axis free to move relative to said rotating surface;

surface-journalling means braced against a periphery of said pressing roll over substantially an entire width of said web for applying said pressing force thereto;

at least one bridge piece swingable about a fulcrum, and carrying said surface-journalling means for urging said surface-journalling means and said pressing roll toward said counterroll;

force-generating means acting upon said bridge piece at a location spaced from said fulcrum for generating said pressing force; and means for adjusting a position of said fulcrum relative to said rotating surface.

* * * * *